United States Patent [19]

Newman

[11] Patent Number: 4,611,573

[45] Date of Patent: Sep. 16, 1986

[54] FIREPLACE GRATE KIT AND GRATE

[76] Inventor: Robert D. Newman, 320 Shire Way, Lawrenceville, Ga. 30245

[21] Appl. No.: 790,368

[22] Filed: Oct. 23, 1985

[51] Int. Cl.[4] ..... F23H 17/08

[52] U.S. Cl. ..... 126/153; 126/164; 126/168

[58] Field of Search ..... 126/164, 165, 168, 152 R, 126/152 A, 152 B, 153, 298, 336; 99/448, 449, 450; 248/172, 558; 108/65, 102, 137; 182/178, 151; 446/489.85; D23/138.1–138.5; 211/60.1

[56] References Cited

U.S. PATENT DOCUMENTS

| | | | |
|---|---|---|---|
| 388,473 | 8/1888 | Bissell | 126/153 |
| 2,868,189 | 1/1959 | Watrous | 126/305 |
| 2,965,097 | 12/1960 | Clark, Jr. | 126/30 |
| 4,140,102 | 2/1979 | Malecki | 126/164 |
| 4,178,844 | 12/1979 | Ward et al. | 248/172 |
| 4,553,523 | 11/1985 | Stohrer, Jr. | 126/152 B |

*Primary Examiner*—James C. Yeung
*Attorney, Agent, or Firm*—Thomas & Kennedy

[57] ABSTRACT

Freestanding fireplace grates of different lengths are assembled from a kit that has a set of U-shaped bars of the same size and shape and a set of nuts and bolts. The assembled grates have a center module interfitted between two side modules. The modules are formed of the U-shaped bars.

13 Claims, 14 Drawing Figures

FIREPLACE GRATE KIT AND GRATE

TECHNICAL FIELD

This invention relates to fireplace grates of the type that may have their lengths adjusted and to kits from which such grates may be assembled.

BACKGROUND OF THE INVENTION

Adjustable grates have heretofore been devised for use with stoves and fireplaces of different dimensions. Exemplary of early adjustable grates are those dislcosed in U.S. Pat. Nos. 376,758, 483,410, 783,954 and 893,671 which essentially used the principle of constructing grates with members that overlapped one another in an adjustable manner whereby their lengths could be altered by increasing or decreasing the degree of overlap. Other early adjustable grates were constructed with an array of longitudinal bars loosely supported upon supports whereby the bars could be intertwined in varying degrees, much like the teeth of two combs, as exemplified by that grate shown in U.S. Pat. No. 893,671. Still other adjustable grates have used perforated pans or plates adapted to be slide one upon the other to adjust overlap, as shown in U.S. Pat. Nos. 1,561,543 and 2,519,263. Recently a grate kit for a wood stove of an adjustable configuration using telescoping members has also been devised as shown in U.S. Pat. No. 4,503,782.

The earlier of the just described grates are ill suited for modern day use for several reasons. For example, the earlier ones were constructed of heavy and often elaborately designed cast iron which configurations today would be extremely costly to construct. Adjustable grates of the type having pans or perforated sheets are ill suited for supporting logs in fireplaces since they would collect the ashes on the pan and hinder the flow of air to the still burning logs. The grate in the last mentioned patent is extendable but such extension is achieved by means of telescoping members that may become fused and which is designed for adaptation to a firebox rather than to be freestanding.

It thus is seem that a need remains for an economic fireplace grate which may be packaged for storage and sale in a compact configuration and readily assembled into freestanding grates of various dimensions for use fireplaces of various sizes in a simple and speedy manner. It is to the provision of such a grate and a kit from which such may be assembled that the present invention is primarily directed.

SUMMARY OF THE INVENTION

In one form of the invention a fireplace grate kit comprises a set of generally U-shaped bars of substantially the same size and shape adapted to be arranged into a compact stack for packaging and later assembled as fireplace grates of different lengths with each bar fastened to at least one other bar. The kit also includes a set of fastening means for fastening the bars together.

In another form of the invention a freestanding fireplace grate comprises a center module interfitted between two side modules. The center module has a leg member to which at least two arm members are transversely secured. Each of the side modules has a pair of leg members to which a pair of arm members is transversely secured. Fireplace greates of different lengths may be constructed with these modules by forming the modules with the center module interfitted between the two side modules and with leg members of each side module crossing different numbers of leg members of the other modules.

DETAILED DESCRIPTION

Figure 1:
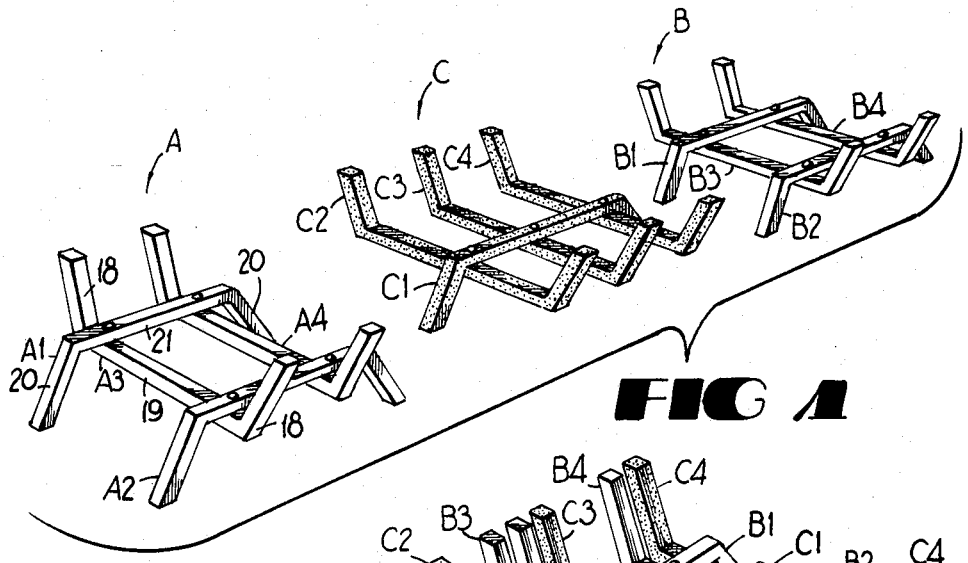
FIG. 1 is an exploded view, in perspective, of a fireplace grate embodying principles of the present invention.
Figure 13:
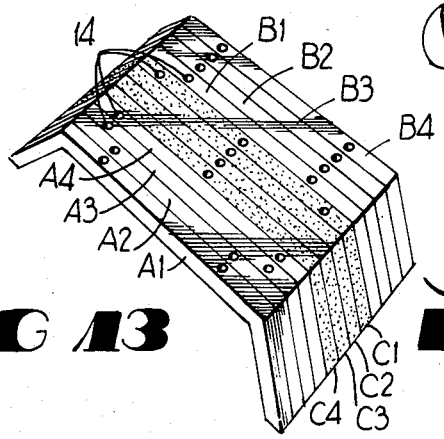
FIG. 13 is a perspective view of the elements of which the three modules illustrated in FIG. 1 are constructed shown stacked for packaging, storage or shipment.
Figure 14:
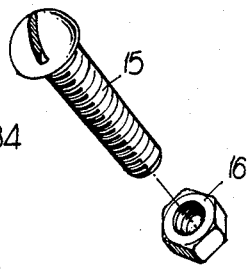
FIG. 14 is an exploded view, in perspective, of one of the nuts and bolts used to fasten together elements of the grates shown in FIGS. 2–13.

With reference next to the drawing there is shown in FIG. 1 three modules that may be interfitted in accordance with principles of the invention to form grates of several different lengths as shown in other figures. these include a center module C and two side modules A and B. The side module A is comprised of four generally U-shaped bars, A1, A2, A3 and A4 and the side module B is comprised of four generally U-shaped bars B1, B2, B3 and B4. The center module C is also comprised of four generally U-shaped bars C1, C2, C3 and C4. Each of the U-shaped bars is formed with at least one hole 14 therethrough, as shown in FIG. 13, and is secured to at least one other bar by means of a bolt 15 extended through aligned holes of crossed bars and secured together by a nut 16. In all, 11 sets of these nuts and bolts are provided for independently assembling the modules A, B and C. All of the U-shaped bars of the three modules are of identical size and shape. Preferably, they are formed of cast iron although other materials could be substituted such as, for examples, bar stock steel or cold roll steel. The nuts and bolts are also identical.

The U-shaped bars of the three modules are shown oriented either uprightly or invertedly. The bars A3, A4, B3, B4 and C2, C3, and C4 are all in an upright orientation to have two arm portions that project upwardly from a cross beam portion. The inverted U-shaped bars A1, A2, B1, B2 and C1 have two dependent leg portions that depend downwardly from a crossbeam portion. It thus is seen that the A3 bar of the A module has two upright arm portions 18 unitarily interconnected by a crossbeam portion 19. Similarly, the A1 bar has two leg portions 20 that depend downwardly from a crossbeam portion 21. The same is true of all of the other U-shaped bars of the three modules but these are not identified by reference numerals for clarity of illustration.

In the drawing the center module C and its bar elements are drawn with stipples in order that they may be readily identified in the various other figures once they have been interfitted between the A and B side modules. The stipples in the drawing therefore are purely for purposes of clarity and do not indicate andy difference in the composition or texture of these bars from the others.

With continued reference to FIG. 1, it is seen that the bars A1 and A2 of module A are mutually parallel and that the bars A3 and A4 are also mutually parallel but are secured to the bars A1 and A2 so as to traverse them at right angles. Similarly, the bars B1 and B2 of module B are mutually parallel and are secured to bars B3 and B4 transversely at right angles with the bars B3 and B4 also being mutually parallel. Careful attention to FIG. 1 will reveal that the bars B1 and B2 are secured to bars B3 and B4 closer together than are bars A1 and A2 secured to bars A3 and A4. This is done so that once the modules are interfitted, portions of the bars A1 and A2 may closely straddle portions of the bars B1 and B2. It will also be seen that the bar C1 of module C is secured at the center points of the bars C2, C3 and C4. Thus, once the modules are interfitted the feet of bar C1 are located laterally midway between the feet of bars A1, A2, B1 and B2.

Figure 5:
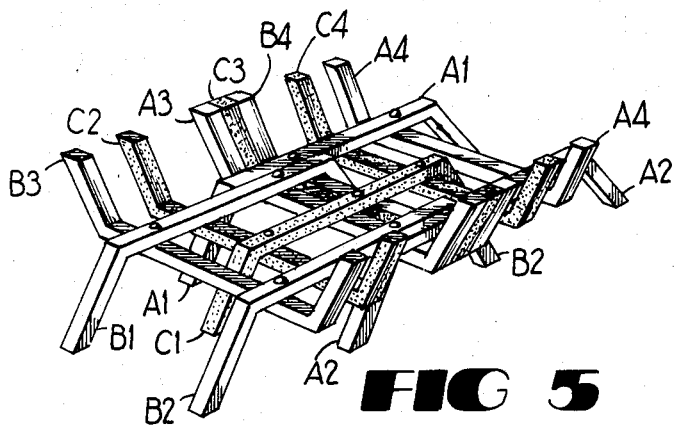
FIG. 5 is a perspective view of a 21 inch length grate constructed of the same three modules shown in FIG. 1.
Figure 6:
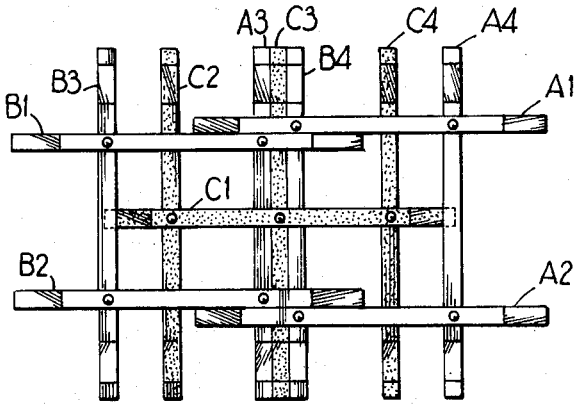
FIG. 6 is a plan view of the grate illustrated in FIG. 5.
Figure 7:
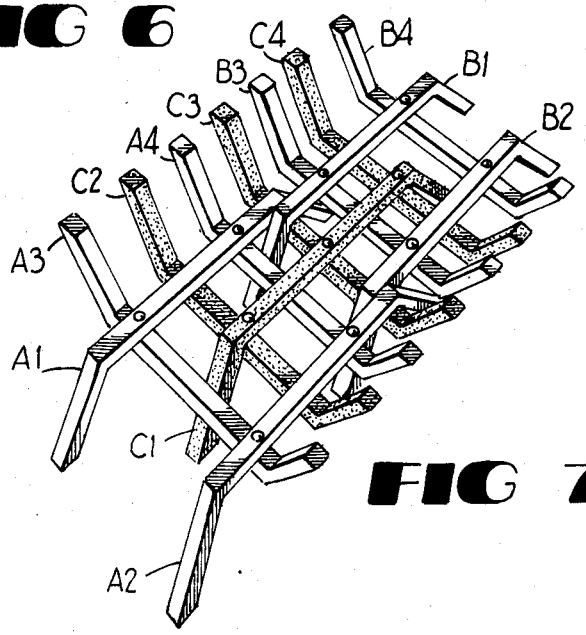
FIG. 7 is a perspective view of a 24 inch length grate constructed of the same three modules shown in FIG. 1.
Figure 8:
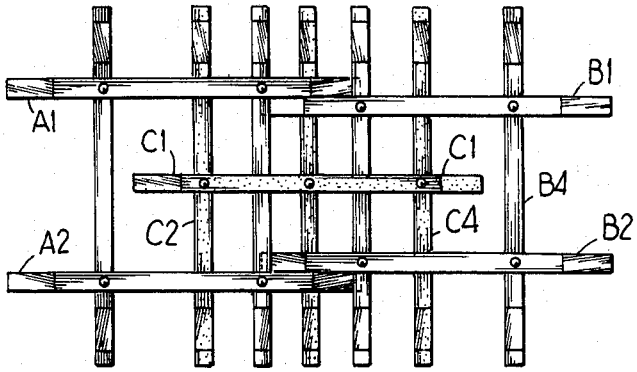
FIG. 8 is a plan view of the grate illustrated in FIG. 7.
Figure 9:
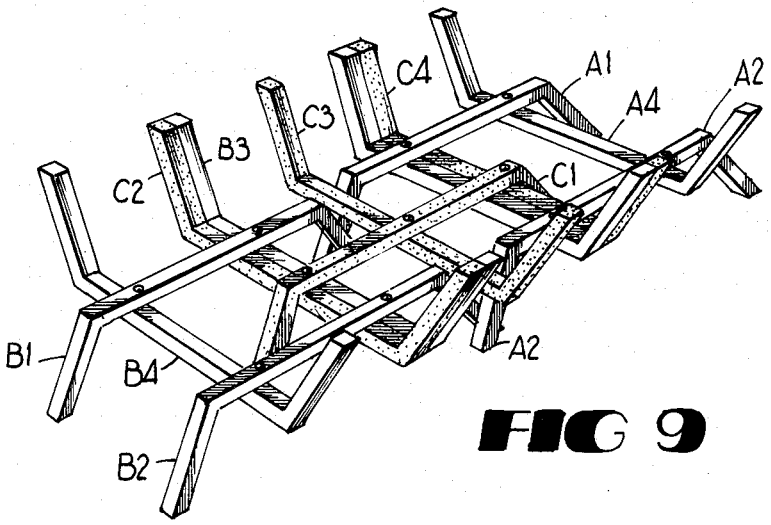
FIG. 9 is a perspective view of a 27 inch length grate constructed with the three modules of FIG. 1.
Figure 10:
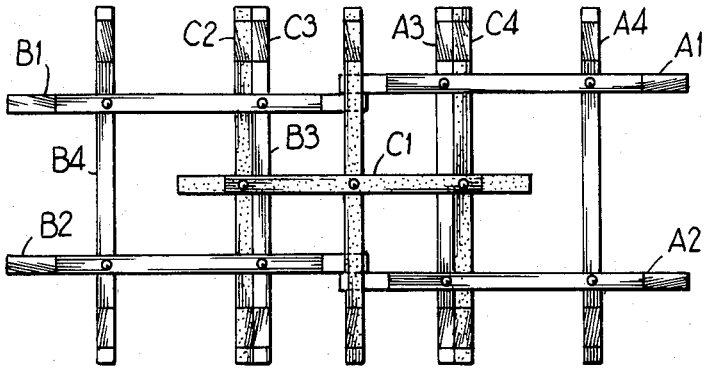
FIG. 10 is a plan view of the grate illustrated in FIG. 9.
Figure 11:
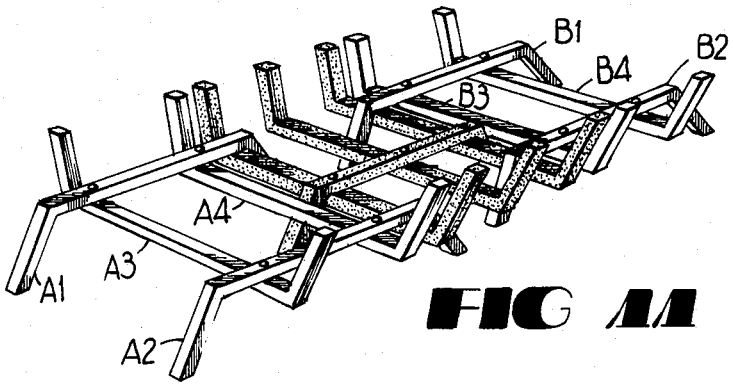
FIG. 11 is a 30 inch length grate constructed with the three modules illustrated in FIG. 1.
Figure 12:
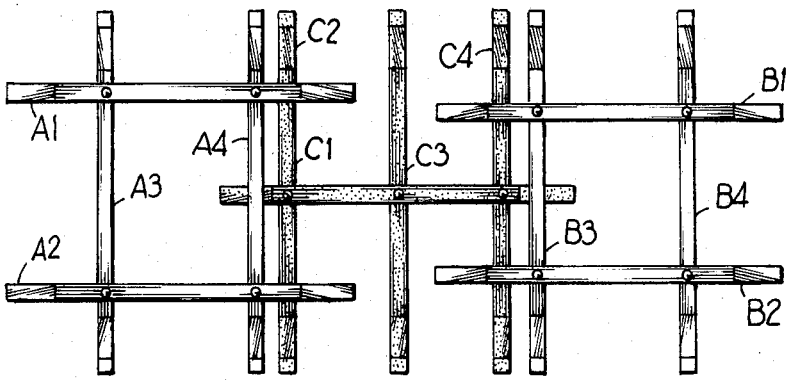
FIG. 12 is a plan view of the grate illustrated in FIG. 11.

The three modules A, B and C may be loosely interfitted to form grates of several different lengths. For example, where all of the U-shaped bars are of a 14 inch length they may be interfitted to form an 18 inch overall length grate like that shown in FIGS. 2–4, a 21 inch grate as shown in FIGS. 5 and 6, a 24 inch grate as shown in FIGS. 7 and 8, a 27 inch grate as shown in FIGS. 9 and 10, or a 30 inch grate as shown in FIGS. 11 and 12. Thus, the bars may be packaged into a kit will all of the 12 bars stacked compactly together, as shown in FIG. 13, and then readily assembled into a grate of the particular size desired by the consumer with all 12 of the bars utilized. This serves to minimize manufacturing, distribution and retailing costs since indentical kits may be purchased and used to construct grates of different sizes. The three modules are interfitted in the process of module assembly itself in all cases here with the exception of the 30 inch grate shown in FIGS. 11 and 13. Here the modules are independently assembled and then merely positioned snuggly together. Thus, it should be understood that the modules A, B and C, in most cases, are not normally assembled independently detached from each other, as shown in FIG. 1, but rather are assembled with some intercrossing of the various elements of the three modules.

Figure 2:
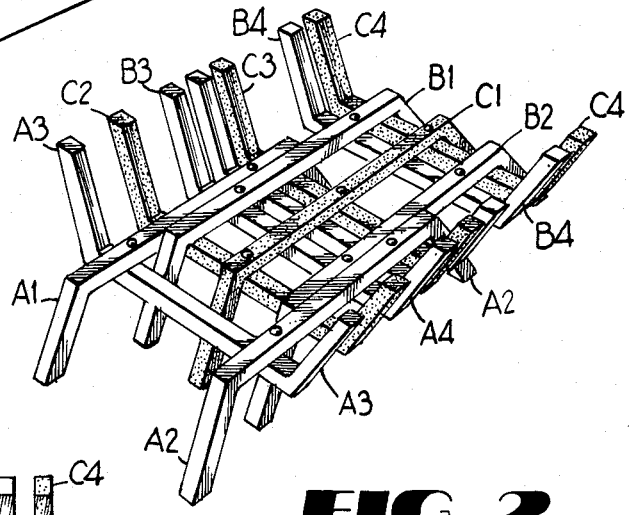
FIG. 2 is a perspective view of an 18 inch length grate constructed of the three modules shown in FIG. 1.
Figure 3:
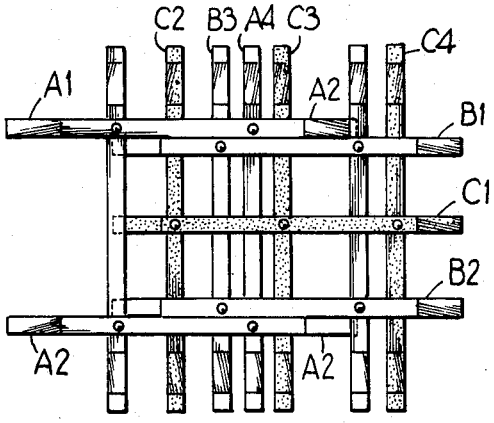
FIG. 3 is a plan view of the grate illustrated in FIG. 2.
Figure 4:
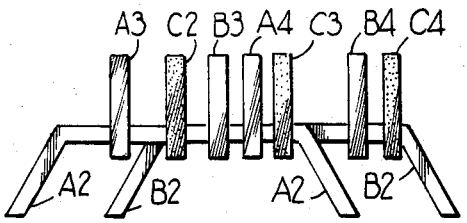
FIG. 4 is a side elevational view of the grate illustrated in FIG. 2.

As previously stated, FIGS. 2–4 illustrated the 18 inch length grate. Here, the legs of modules A and C are located at fairly evenly distributed points in a lengthwise direction for enhanced stability, as shown most clearly in FIG. 4. In this case it will be noted that the legs of bar C1 are positioned at the same lengthwise location as legs of the modules A and B. Since they are located laterally midway between those legs their locations enhance support in the lateral direction. In FIGS. 5 and 6 the same U-shaped bars are shown assembled into a grate of 21 inch overall length. Again, it should be appreciated that the legs are well distributed for support both in the lengthwise and lateral directions. Visual symmetry is thus provided as readily appreciated from the plan view of FIG. 6 where the position of the legs of the center module C cooperate with those of the side modules A and B to provide left side and right side symmetry. Again, lateral symmetry is also maintained by the position of the crossbeam portion of bar C1 being located midway between the crossbeam portions of bars A1, A2 and B1 and B2.

in FIGS. 7 and 8 a 24 inch grate is constructed with the same bars and fastening means. Here again it is seen that both sound aesthetics and support are provided by the symmetry and relatively even distribution of the various bars. In FIGS. 10 and 11 a 27 inch grate is provided with both support and aesthetic symmetry as may be readily appreciated from a viewing of the figures. Finally in FIGS. 11 and 12 a 30 inch length grate is provided. Here, though the bar elements of the center grate C do not cross over, in an interlacing fashion, the bar elements of the side modules A and B. The feet of bars C1 engage bars A4 and B3 of the side modules, and the bars C2 and C4 of the center module cross the bars A1, A2, B1 and B2 of the side modules, for stability. Thus, even here the grates may not be separated until they are raised from the floor and manually disengaged.

Though grates of specific lengths have been illustrated constructable from bar elements of a common size, it should be understood that the lengths given are just by way of illustration. Also, though the bars with upturned arms in all of the embodiments have been shown mounted beneath the bars with legs, they may instead be all mounted atop the leg bars.

It thus is seen that a kit is provided for readily forming grates of various lengths with ease and with the resulting grates being aesthetically pleasing and having good distribution of log supporting arms and good distribution of legs for grate stability. The elements of the kit may be packaged in a highly compact configuration and later readily assembled into grates of a desired length. The grate may still later be reconfigured into a different length, if desired, to accomodate another size fireplace. It thus should be understood that the just described embodiments merely illustrate principles of the invention in one preferred forms. Many other modifications, additions and deletions may be made thereto without departure from the spirit and scope of the invention as set forth in the following claims.

I claim:

1. A freestanding fireplace grate comprising a center module interfitted between two side modules, said center module having a leg member to which at least two arm members are transversely secured, and each of said side modules having a pair of leg members to which a pair of arm members is transversely secured, whereby fireplace grates of different lengths may be constructed with the modules by forming the modules with the center module interfitted between the two side modules and with the leg members of each side modules crossing different numbers of leg members of the other modules.

2. The fireplace grate of claim 1 wherein each of said leg members of said center module and side modules is of a generally U-shaped configuration.

3. The fireplace grate of claim 1 wherein each of said leg members of said center module and said side modules is of substantially identical shape and size.

4. The fireplace grate of claim 1 wherein each of said arm members of said center module and said side modules is of a generally U-shaped configuration.

5. The fireplace grate of claim 1 wherein each of said arm members of said center module and said side members is of substantially identical size and shape.

6. The fireplace grate of claim 1 wherein all of said arm members and leg members of all of said modules are of substantially the same size and shape.

7. The fireplace grate of claim 1 wherein said center module has three arms transversely secured to said center module leg member.

8. The fireplace grate of claim 1 wherein said center module intercrosses portions of each of said side modules.

9. The fireplace grate of claim 8 wherein all of said arm members of said modules are mutually parallel and all of said leg members of said modules are mutually parallel.

10. The fireplace grate of claim 1 wherein leg members of said pair of leg members of one of said side modules are spaced apart a distance greater said leg members of said pair of leg members of the other of said side modules, whereby a portion of said pair of leg members of said one side module may straddle a portion of said pair of leg members of said other side module.

11. The fireplace grate of claim 1 wherein said center module is loosely interfitted between said two side modules and unconnected thereto.

12. A freestanding fireplace grate having two modules each comprised of two pairs of generally U-shaped bars of the same size and shape secured together with one pair transversing the other pair at right angles, and wherein the bars of one pair of one module are spaced apart a distance greater than one pair of bars of the other module whereby the two modules may be interfitted with a portion of said one pair straddling a portion of said other modules one pair.

13. The freestanding fireplace grate of claim 12 wherein said two pair of bars of each of said modules are secured together within opposite orientations.

* * * * *